US010738647B2

(12) United States Patent
Braun et al.

(10) Patent No.: US 10,738,647 B2
(45) Date of Patent: Aug. 11, 2020

(54) BURST PROTECTION DEVICE FOR A GAS TURBO ENGINE

(71) Applicant: MAN ENERGY SOLUTIONS SE, Augsburg (DE)

(72) Inventors: Steffen Braun, Augsburg (DE); Daniel Albrecht, Augsburg (DE); Harald Denkel, Baar (DE); Stefan Weihard, Augsburg (DE); Bernd Haas, Neusäss (DE); Johannes Niebuhr, Augsburg (DE); Urban Spatz, Neusäss (DE)

(73) Assignee: MAN Energy Solutions SE, Augsburg (DE)

( * ) Notice: Subject to any disclaimer, the term of this patent is extended or adjusted under 35 U.S.C. 154(b) by 43 days.

(21) Appl. No.: 16/250,270

(22) Filed: Jan. 17, 2019

(65) Prior Publication Data

US 2019/0218931 A1 Jul. 18, 2019

(30) Foreign Application Priority Data

Jan. 18, 2018 (DE) ..... 10 2018 101 066

(51) Int. Cl.
*F01D 21/04* (2006.01)
*F01D 25/24* (2006.01)
*F02B 39/16* (2006.01)

(52) U.S. Cl.
CPC ..... *F01D 21/045* (2013.01); *F01D 25/24* (2013.01); *F02B 39/16* (2013.01); *F05D 2220/40* (2013.01); *F05D 2240/14* (2013.01)

(58) Field of Classification Search
CPC ..... F01D 21/045; F01D 25/24; F01D 25/26; F02B 39/16; F05D 2220/40; F05D 2240/14
See application file for complete search history.

(56) References Cited

U.S. PATENT DOCUMENTS 4,818,176 A * 4/1989 Huether ..... F01D 21/045 415/224
4,875,837 A 10/1989 Usami et al.
6,837,674 B2 * 1/2005 Phillips, III ..... F04D 27/008 415/1
6,997,672 B2 * 2/2006 Wand ..... F01D 9/026 415/1
8,528,328 B2 * 9/2013 Stroph ..... F01D 9/026 60/605.1

(Continued)

FOREIGN PATENT DOCUMENTS

DE 42 23 496 1/1994
DE 196 40 654 4/1998

*Primary Examiner* — Igor Kershteyn
(74) *Attorney, Agent, or Firm* — Cozen O'Connor

(57) ABSTRACT

A burst protection device for a gas radial turbo engine configured annularly around a central axis in the circumferential direction and like a box in a cross sectional direction, to grip a turbine housing in the area of the turbine wheel. The burst protection device includes at least one axial wall section extending in an axial direction and at least one radial wall section extending in the radial direction are indirectly interconnected via an intermediate wall section lying in between. A partial area of the intermediate wall section in the axial direction runs inclined and/or curved relative to the orientation of the axial wall section and radial wall section.

11 Claims, 1 Drawing Sheet

(56) References Cited

U.S. PATENT DOCUMENTS

| | | | | |
|---|---|---|---|---|
| 2004/0109759 | A1* | 6/2004 | Korner | F01D 25/26<br>415/205 |
| 2019/0072004 | A1* | 3/2019 | Braun | F01D 25/08 |
| 2019/0093515 | A1* | 3/2019 | Braun | F01D 25/26 |
| 2019/0153898 | A1* | 5/2019 | Braun | F01D 25/16 |
| 2019/0226361 | A1* | 7/2019 | Spatz | F01D 25/26 |
| 2019/0242272 | A1* | 8/2019 | Braun | F01D 25/145 |
| 2019/0284956 | A1* | 9/2019 | Denkel | F01D 25/24 |

* cited by examiner

BURST PROTECTION DEVICE FOR A GAS TURBO ENGINE

BACKGROUND OF THE INVENTION

1. Field of the Invention

The invention relates to a burst protection device for a gas turbo engine with a turbine housing that completely encompasses a turbine wheel rotatably arranged in the turbine housing, an internal combustion engine with such a gas turbo engine, and a gas turbo engine with such a burst protection device.

2. Description of the Related Art

A turbocharger, also referred to as an exhaust gas turbocharger (ATL) or colloquially as a turbo, is an optional assembly of a combustion engine, and serves to increase performance or efficiency.

An exhaust gas turbocharger consists of a compressor and a turbine, which are connected with each other by a shared shaft. Driven by the exhaust gases of the combustion engine, the turbine delivers the driving energy for the compressor. In most cases, radial compressors and centripetal turbines are used for turbochargers.

The basic principle involves using part of the energy from the engine exhaust gas to increase the pressure in the intake system, and thereby convey more outside air into the cylinder than with the engine not turbocharged, which leads to an increase in efficiency. As a consequence, turbochargers can use the pressure (accumulation charging) and kinetic energy of the exhaust gases (pulse charging). An additional intercooler can be used to achieve a higher working pressure at the same temperature in the cylinder.

Conceptually, the compressor and turbine have an air conducting spiral, which guides the exhaust gases for the turbine, and to transport the aspirated air of the engine for the compressor.

Currently known high-performance turbo engines, such as exhaust gas turbochargers of turbocharged internal combustion engines, pose a high risk to their environment in the event of a technical failure of the rotating parts of the turbocharger. In particular during operation in situations where people may be in the immediate vicinity of the turbo engine, it must be ensured that, in the event of a failure, i.e., a bursting, all parts can be reliably and completely collected and not injure any people.

In order to prevent fragments from penetrating through the outer wall of the turbocharger, and hence any endangerment of people or damage to adjacent machine parts, the turbochargers were in the past provided with relatively thick walls in the turbine housing in the area radially outside of the turbine runner. However, these solutions are associated with a series of disadvantages, e.g., the significant additional weight and the danger of void formations owing to the poorer castability of such a turbine housing. In addition, a housing thickened in this way heats up differently, which can result in thermal cracks.

Known from DE 42 23 496 A1 is a device for reducing the kinetic energy of bursting parts for machines that rotate at a high speed. This device is arranged inside of an axial turbine, and consists of several interconnected protective rings, between which is formed a respective crumple zone made out of a ductile material. However, this type of solution is not suitable for radial turbines, because their radial gas inlet does not allow any burst protection devices to be placed in the radial area of the turbine.

Known from publication U.S. Pat. No. 4,875,837 A is a multilayer burst protector, in which a heat insulating material is introduced into an iron plate, and which is fastened spaced apart from a turbine housing and to a spiral part of the turbine housing. However, the disadvantage to the burst protector described therein is the fact that this burst protector only envelops a 120° angle region of the spiral part of the housing, and thus has a partially open design.

Known from DE 196 40 654 A1 is another burst protector, which is provided outside of a gas inlet housing of a radial turbine for a turbocharger, which is designed as a spiral sheet metal casing, and detachably connected with the gas inlet housing by several screws.

Also known are solutions in which curved metal sheets are arranged around the spiral as a burst protector, which while structurally simple in design to reduce manufacturing costs, only have a limited strength and rigidity, and also behave unfavorably in terms of how they respond to arising natural frequencies during operation.

SUMMARY OF THE INVENTION

An object of one aspect of the present invention is to avoid the aforesaid disadvantages and provide an improved, easy to manufacture and reliable burst protection device for radial turbines of turbochargers, and thereby further improve the safety of turbochargers, wherein disadvantageous effects owing to the natural frequencies that arise during operation are to be lowered.

One basic idea of the invention involves configuring a burst protection device such that it is formed around the spiral of the turbine and has a specifically formed structure comprised of several sections, which run in a radially circumferential manner, and interconnecting at least one axial section extending in the axial direction and at least one radial section extending in the radial direction via an inclined intermediate section lying in between, which preferably runs in at least one partial area, respectively inclined and/or curved relative to the orientation of the axial section and radial section.

For this reason, the invention provides a burst protection device for a gas turbo engine, in particular a gas radial turbo engine, with a turbine housing that completely encompasses a turbine wheel rotatably arranged in the turbine housing, wherein the burst protection device is configured annularly around a central axis in the circumferential direction and like a box in a cross sectional direction, so as to grip the turbine housing in the area of the turbine wheel, wherein the burst protection device further comprises several wall sections arranged side by side in the circumferential direction, and at least one axial wall section extending in the axial direction and at least one radial wall section extending in the radial direction are indirectly interconnected via an intermediate wall section lying in between, and at least a partial area of the intermediate wall section in the axial direction runs inclined and/or curved relative to the orientation of the axial wall section and radial wall section.

It is advantageous that the burst protection device be further integrally configured out of several wall sections arranged side by side in the circumferential direction.

It is especially advantageous that two radial wall sections extend in the radial direction and be indirectly connected with the axial wall section via a respective intermediate wall section lying in between. As a consequence, the burst protection device preferably has two radial wall sections extending in the radial direction, between which the axial wall section is located. In the cross section as viewed through the burst protection device (given a section transverse to the circumferential direction), this yields an inwardly open box shape for receiving a spiral exhaust gas conducting channel of the turbine, the center of which accommodates the turbine wheel.

A preferred embodiment of the invention provides that the two radial wall sections extending in the radial direction each be oriented by an angle of about 90° relative to the axil wall section, and that the intermediate wall sections run inclined and/or curved relative to the axial wall section by an angle $\alpha$ relative to its axial extension.

It is further advantageous that the burst protection device be integrally configured out of one or several sheet metal parts, which have a high dielectric strength.

Another advantageous embodiment of the invention provides that the intermediate wall sections be designed as wall sections running flatly in essentially one direction, which are oriented relative to the axial direction at a positive or negative angle $\alpha$ of between 30° and 60°, preferably of between 40° and 50°, and especially preferably at an angle of 45°. In any event, angles on the order of 90° (as in part known from prior art) are undesired, since this shape has proven unfavorable for various properties of the burst protection device, e.g., strength, vibration behavior, stiffness, etc.

Another aspect of the present invention relates to a gas turbo engine, in particular to a gas radial turbo engine, with a turbine housing having a turbine wheel rotatably arranged in the turbine housing and a burst protection device of the kind described above arranged around the turbine housing.

An embodiment here preferred provides that the turbine housing form a spiral gas conducting channel, one side of which has an exhaust gas feeder, and that the burst protection device at least partially envelop the gas conducting channel.

Another advantageous embodiment provides that the axial wall section of the burst protection device extend in an axial direction over a central partial section of the spiral gas conducting channel, while the front and rear partial sections not covered by the axial wall section are at least partially covered by the intermediate wall sections with an inclined orientation. As a consequence, the burst protection device can be guided along the surface contour of the gas conducting channel, and hence of the turbine housing, spaced a small distance away, which has a favorable effect on reducing the kinetic energy of the burst splitter in the event of a burst.

It is advantageously provided that a first radial wall section here be arranged in front of a front side wall section, that a second radial wall section be arranged behind a rear side wall section of the gas conducting channel, and that the front and rear radial wall sections each be connected with the axial wall section by inclined or curved intermediate wall sections.

Another aspect of the present invention relates to an internal combustion engine with a gas turbo engine as described above.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Other advantageous further developments of the invention are characterized in the subclaims, or will be shown in greater detail below together with the description of the preferred embodiment of the invention based on the figures. Shown on:

DETAILED DESCRIPTION OF THE PRESENTLY PREFERRED EMBODIMENTS

The invention will be described in more detail below with reference to FIGS. 1 and 2, wherein the same reference numbers indicate the same structural and/or functional features.

Figure 1:
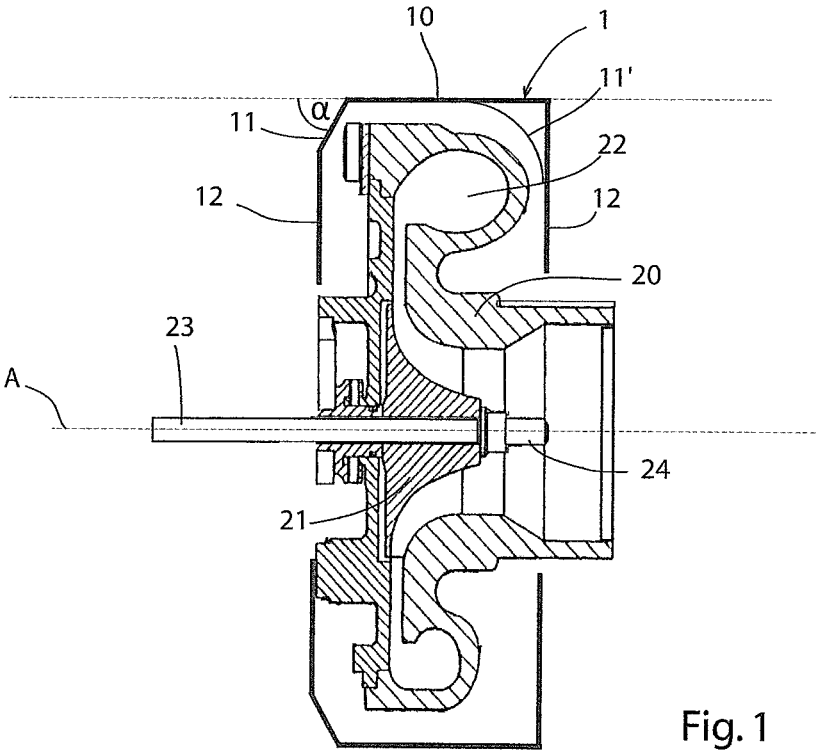
FIG. 1 is a burst device according to the present invention.
Figure 2:
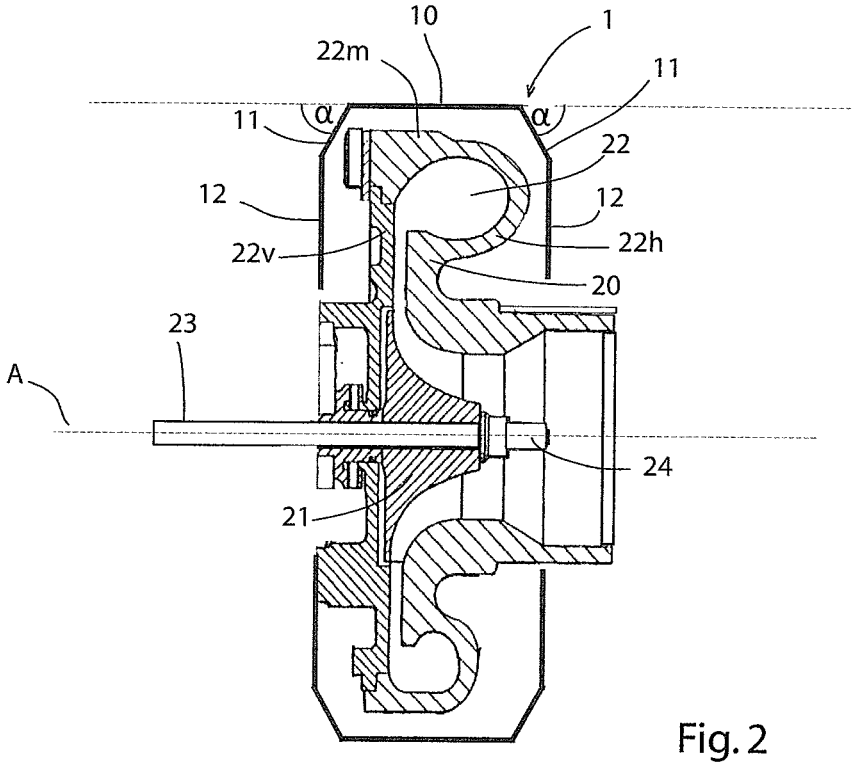
FIG. 2 is a burst device according to the present invention.

FIGS. 1 and 2 show a sectional view of two exemplary embodiments of a respectively alternative configuration of a burst protection device 1 in an assembly situation, mounted around a turbocharger (depicted in a partial view).

Shown is the respective turbine housing 20 of a gas turbo engine with a turbine wheel 21 that is rotatably arranged in the turbine housing 20 and fastened to the turbocharger axis 23 by fastner 24. The turbine housing 20 encompasses a spiral gas conducting channel 22 for conducting the exhaust gas flow, one side of which has an exhaust gas feeder.

The two embodiments further show a burst protection device 1 that at least partially engages around the spiral turbine housing in the area of the gas conducting channel 22.

The burst protection device 1 is shaped to run around the central axis A through the turbocharger axis 23 annularly in the circumferential direction and like a box in a cross sectional direction, so as to grip the turbine housing 20 in the aforesaid area of the turbine wheel 21.

In both embodiments FIGS. 1 and 2, the respective burst protection device 1 is integrally formed out of a dielectric sheet metal having several wall sections 10, 11, 12 arranged side by side in the circumferential direction, wherein a respective axial wall section 10 of the burst protection device 1 extending in an axial direction (i.e., in the direction of the turbocharger axis 23) runs around the turbine housing 20 like a cover. The respective wall sections 10, 11, 12 are designed as flatly running wall sections. However, the intermediate wall section 11 can also run like a curved section 11', as exemplarily shown on FIG. 1 with a thinner curved line.

In the upper exemplary embodiment according to FIG. 1, a radial wall section 12 further extending in the radial direction (i.e., transversely to the axial direction) is indirectly connected with the axial wall section 10 by an inclined intermediate wall section 11.

In the lower exemplary embodiment according to FIG. 2, two radial wall sections 12 extending in the radial direction are each indirectly connected with the axial wall section 10 by a respective inclined intermediate wall section 11.

The intermediate wall sections 11 are inclined relative to the axial wall section 10 at an angle $\alpha$ of about 55° in comparison to its axial extension. As designated on FIG. 2 with the left or right angle $\alpha$, the latter can alternatively also be respectively oriented at a positive or negative angle $\alpha$ of between 30° and 60°, preferably of between 40° and 50°, and especially preferably at an angle of 45°. The angles can be the same or different, depending on how the burst protection device 1 is to be adjusted along the outer contour of the turbine housing 20 of the latter. As already explained, the shape of the intermediate wall section 11 can also be a combination of linear and curved shapes, so as to make a specific adjustment.

In FIG. 2, the axial wall section 10 of the burst protection device 1 runs in an axial direction over a central partial section 22*m* of the spiral gas conducting channel 22, while the partial sections not covered by the axial wall section 10 are at least partially covered by the intermediate wall sections 11 with an inclined orientation. The first (left) radial wall section 12 is arranged in front of a front side wall section 22*v*, and the second (right) radial wall section 12 is arranged in back of a rear side wall section 22*h* of the gas conducting channel 22. The front and rear radial wall sections 12 are each connected with the axial wall section 10 via the inclined intermediate wall sections 11 described above.

The invention is not limited in its implementation to the preferred exemplary embodiments indicated above. Rather, a plurality of variants is conceivable, which make use of the described solution even in embodiments that are fundamentally different.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A burst protection device for a gas radial turbo engine, with a turbine housing that completely encompasses a turbine wheel rotatably arranged in the turbine housing, wherein the burst protection device is configured annularly around a central axis in a circumferential direction and like a box in a cross sectional direction, to grip the turbine housing in an area of the turbine wheel, wherein the burst protection device comprises:

several wall sections arranged side by side in the circumferential direction, comprising:

at least one axial wall section extending in an axial direction;

at least one radial wall section extending in a radial direction; and an intermediate wall section arranged between and interconnecting the at least one axial wall section and the at least one radial wall section;

wherein at least a partial area of the intermediate wall section in the axial direction is inclined and/or curved relative to an orientation of the at least one axial wall section and the at least one radial wall section.

2. The burst protection device according to claim 1, wherein the burst protection device is integrally configured out of the several wall sections arranged side by side in the circumferential direction.

3. The burst protection device according to claim 1, wherein the burst protection device has two radial wall sections extending in the radial direction, between which the at least one axial wall section is located.

4. The burst protection device according to claim 3, wherein the two radial wall sections extending in the radial direction are each connected with the at least one axial wall section, and respective intermediate wall sections run inclined and/or curved relative to the respective axial wall section by a respective angle $\alpha$ relative to the respective axial wall section's axial extension.

5. The burst protection device according to claim 1, wherein the burst protection device is integrally configured out of one or more sheet metal parts.

6. The burst protection device according to claim 1, wherein the intermediate wall section are oriented relative to the axial direction at a positive or negative angle $\alpha$ at least one of:

between 30° and 60°, between 40° and 50°, and at an angle of 45°.

7. A gas radial turbo engine, comprising:

a turbine housing that completely encompasses a turbine wheel rotatably arranged in the turbine housing; and a burst protection device, wherein the burst protection device is configured annularly around a central axis in a circumferential direction and like a box in a cross sectional direction, to grip the turbine housing in an area of the turbine wheel, wherein the burst protection device comprises:

several wall sections arranged side by side in the circumferential direction, comprising:

at least one axial wall section extending in an axial direction;

at least one radial wall section extending in a radial direction; and an intermediate wall section arranged between and interconnecting the at least one axial wall section and the at least one radial wall section;

wherein at least a partial area of the intermediate wall section in the axial direction is inclined and/or curved relative to an orientation of the at least one axial wall section and the at least one radial wall section.

8. The gas turbo engine according to claim 7, wherein the turbine housing forms a spiral gas conducting channel, one side of which has an exhaust gas feeder, and the burst protection device at least partially envelops the spiral gas conducting channel.

9. The gas turbo engine according to claim 8, wherein the axial wall section of the burst protection device extends in the axial direction over a central partial section of the spiral gas conducting channel, while the partial sections not covered by the axial wall section are at least partially covered by the intermediate wall section with an inclined orientation.

10. The gas turbo engine according to claim 8, wherein a first radial wall section is arranged in front of a front side wall section, and a second radial wall section is arranged behind a rear side wall section of the spiral gas conducting channel, and an inclined or curved intermediate wall section connects the front and the rear radial wall sections.

11. An internal combustion engine with a gas turbo engine, comprising:

a turbine housing that completely encompasses a turbine wheel rotatably arranged in the turbine housing; and a burst protection device, wherein the burst protection device is configured annularly around a central axis in a circumferential direction and like a box in a cross sectional direction, to grip the turbine housing in an area of the turbine wheel, wherein the burst protection device comprises:

several wall sections arranged side by side in the circumferential direction, comprising:

at least one axial wall section extending in an axial direction;

at least one radial wall section extending in a radial direction; and an intermediate wall section arranged between and interconnecting the at least one axial wall section and the at least one radial wall section;

wherein at least a partial area of the intermediate wall section in the axial direction is inclined and/or curved relative to an orientation of the at least one axial wall section and the at least one radial wall section.

* * * * *